US007849967B2

(12) United States Patent
Gibson et al.

(10) Patent No.: US 7,849,967 B2
(45) Date of Patent: Dec. 14, 2010

(54) FOLDABLE STEPLADDER WITH STEP LOCK

(75) Inventors: William R. Gibson, Kent, OH (US); Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 920 days.

(21) Appl. No.: 11/672,471

(22) Filed: Feb. 7, 2007

(65) Prior Publication Data

US 2007/0181369 A1 Aug. 9, 2007

Related U.S. Application Data

(60) Provisional application No. 60/743,244, filed on Feb. 7, 2006.

(51) Int. Cl.
*E06C 1/393* (2006.01)

(52) U.S. Cl. ..... 182/176; 182/25; 182/165

(58) Field of Classification Search ..... 182/25, 182/165, 176, 180.1
See application file for complete search history.

(56) References Cited

U.S. PATENT DOCUMENTS 2,652,967 A * 9/1953 Hansen ..... 182/123
2,781,961 A * 2/1957 Bendick ..... 182/176
3,084,760 A * 4/1963 Lamberti ..... 182/160
4,565,262 A 1/1986 Hawkins
5,158,151 A * 10/1992 Chang ..... 182/159
5,163,533 A * 11/1992 Lin ..... 182/176
5,722,507 A 3/1998 Kain
6,390,238 B1 5/2002 Gibson et al.
6,427,805 B1 * 8/2002 Gibson et al. ..... 182/165
6,443,261 B1 9/2002 Gibson et al.
6,454,050 B2 9/2002 Gibson et al.
6,550,579 B2 4/2003 Gibson et al.
6,769,515 B2 8/2004 Hillebrecht et al.
6,902,035 B2 * 6/2005 Baumgartner et al. ..... 182/165
7,104,362 B2 9/2006 Meeker
7,108,103 B2 9/2006 Meeker

FOREIGN PATENT DOCUMENTS

GB 1038322 8/1966

OTHER PUBLICATIONS

International Search Report for International Application No. PCT/US07/61762, mailed Dec. 13, 2007.

* cited by examiner

*Primary Examiner*—Katherine W Mitchell
*Assistant Examiner*—Daniel Cahn
(74) *Attorney, Agent, or Firm*—Barnes & Thornburg LLP

(57) ABSTRACT

A stepladder includes a longer inclined frame provided with steps coupled to a shorter stabilizer frame provided with rungs for movement relative to the longer inclined frame between an expanded use position and a collapsed storage position. The stepladder also includes a top-step lock to lock the top step in a fixed position relative to the two frames.

14 Claims, 10 Drawing Sheets

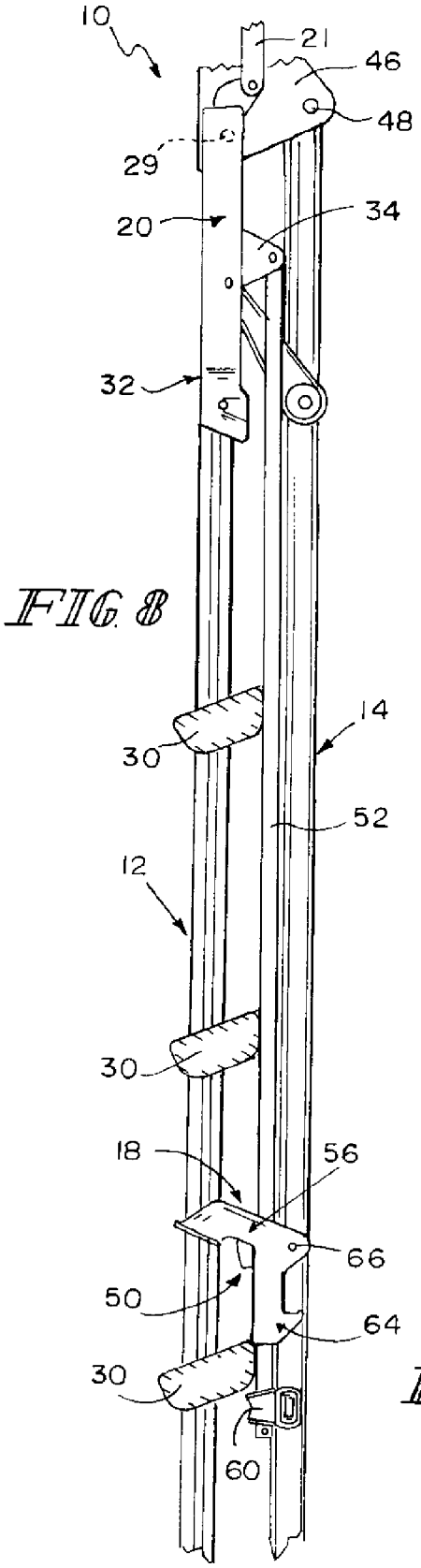
FIG. 8
FIG. 9
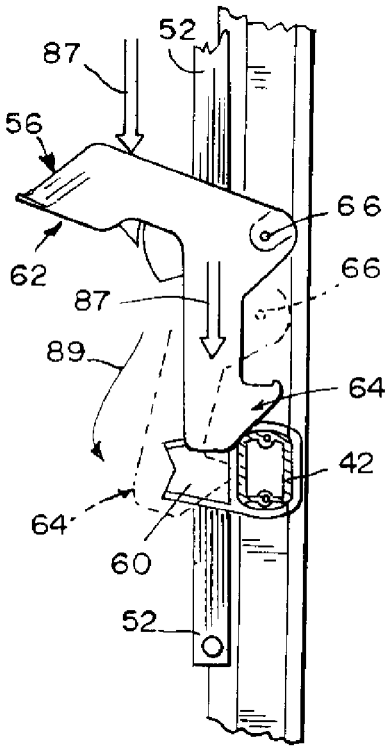
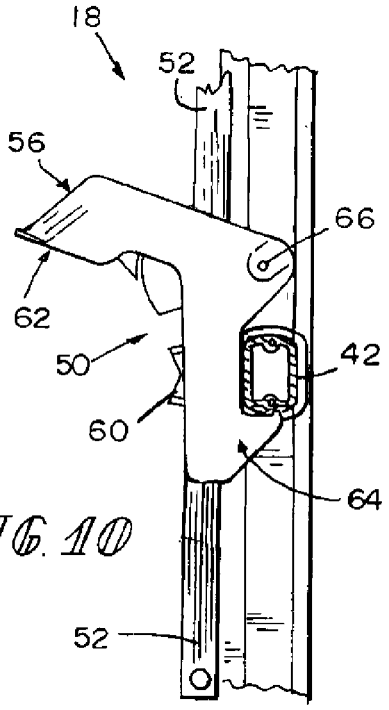
FIG. 10

FOLDABLE STEPLADDER WITH STEP LOCK

This application claims benefit of U.S. Provisional Patent Application Ser. No. 60/743,244, filed Feb. 7, 2006, which application is hereby incorporated by reference herein.

BACKGROUND

The present disclosure relates to a ladder, and particularly to a folding stepladder. More particularly, the present disclosure relates to a folding stepladder including a step lock.

Stepladders have a frame and one or more steps that people use for elevation when reaching for objects, painting walls, or any everyday task where extra elevation would be helpful. Stepladders are often foldable for ease of storage when the stepladder is not being used.

SUMMARY

According to the present disclosure, a stepladder includes a longer inclined frame provided with steps coupled to a shorter stabilizer frame provided with rungs for movement relative to the longer inclined frame between an expanded use position and a collapsed storage position. The stepladder also includes a top-step lock including an extension rod extending upwardly along the stabilizer frame to a top step of the stepladder and a rod locker used to lock the extension rod to the stabilizer frame to lock the top step in a fixed position relative to the two frames.

The rod locker includes a pivotable latch mounted for pivotable movement about a horizontal pivot axis to a latch mount block included in the rod locker. The latch mount block is fixedly coupled to the extension rod. The pivotable latch further includes a pair of spaced-apart latch hooks to engage a horizontal anchor rung coupled to the stabilizer frame.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 8 is a side elevation view of the stepladder of FIG. 1, with portions broken away, showing the stepladder in the collapsed storage position and showing a lower portion of the extension rod extending through a channel formed in a rod guider included in the rod locker and coupled to the anchor rung in the stabilizer frame for sliding movement therein and showing separation of the pivotable latch mounted on the extension rod from the anchor rung when the step ladder is not in the expanded use position as shown in FIGS. 5 and 6;

FIG. 9 is an enlarged partial side elevation view of the stepladder of FIG. 8 showing camming movement of the latch hook on the anchor rung during movement from an unlocked position above the anchor rung toward a pivoted position (in phantom) alongside the anchor rung;

FIG. 10 is a view similar to FIG. 9 showing locking engagement of the first latch hook and the anchor rung when the rod locker in the locked position and the stepladder is in the expanded use position of FIGS. 1 and 3;

DETAILED DESCRIPTION

Figure 1:
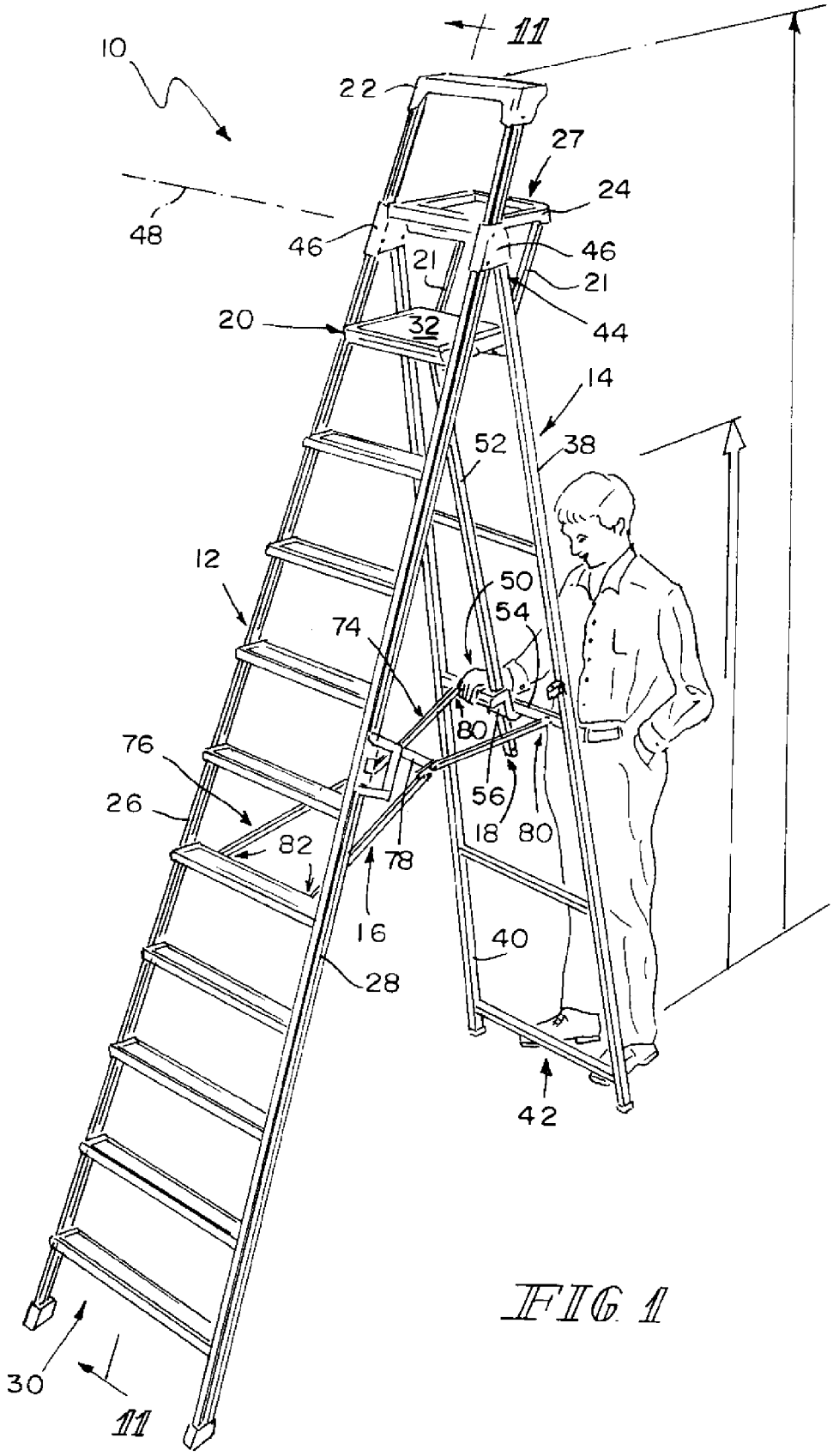
FIG. 1 is a perspective view of a stepladder in accordance with the present disclosure showing a longer inclined frame provided with steps coupled to a shorter stabilizer frame provided with rungs, the stabilizer frame being stabilized by a person, an "H-shaped" horizontal brace extending between the inclined frame and the stabilizer frame, and a top-step lock (shown more clearly in FIG. 5) including an extension rod extending upwardly along the stabilizer frame to a top step of the stepladder and a rod locker located near the person's hand and used to lock the extension rod to the stabilizer frame to lock the top step in a fixed position relative to the two frames.
Figure 2:
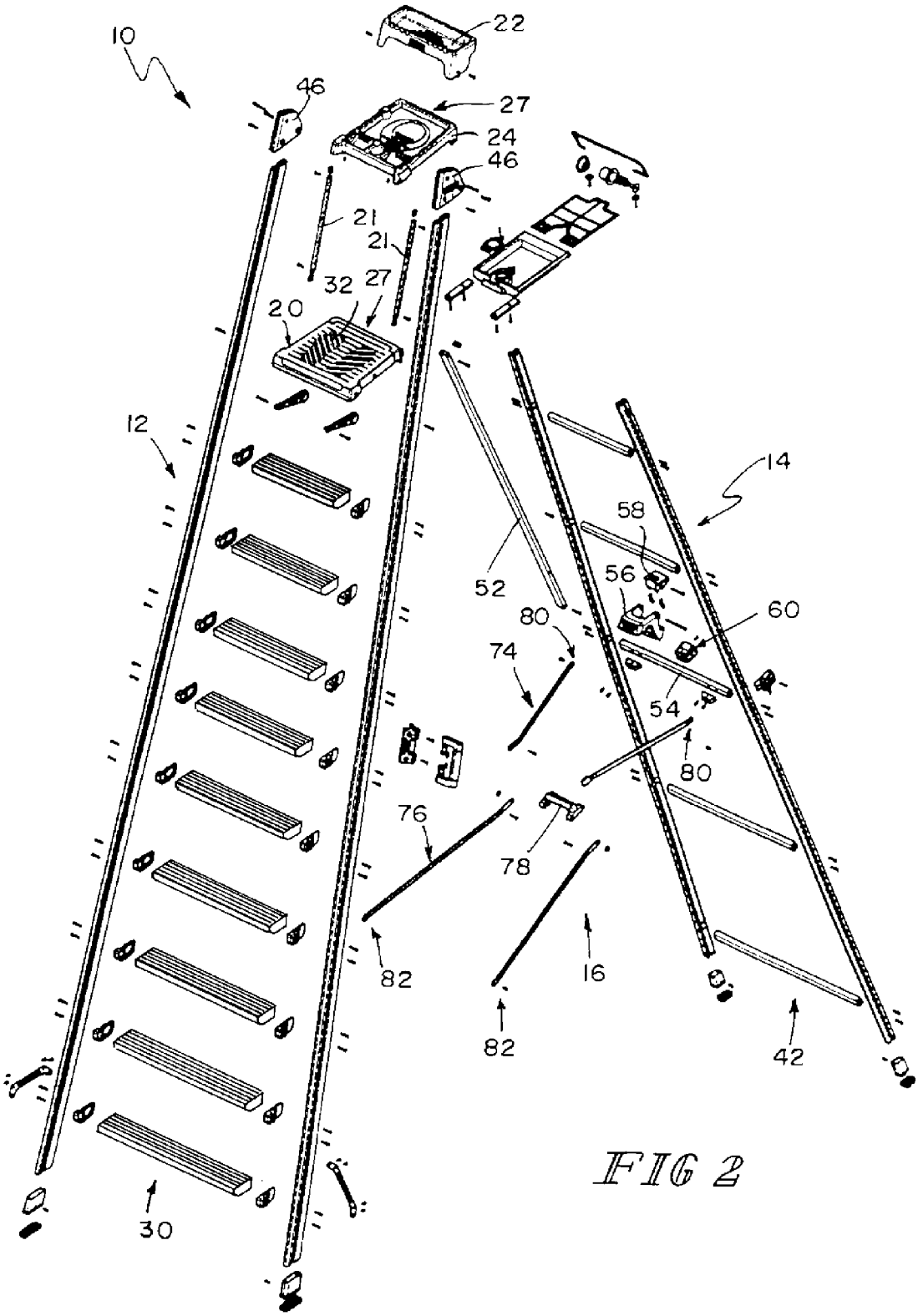
FIG. 2 is an exploded perspective view of illustrative components included in the stepladder of FIG. 1.

A stepladder 10 includes a longer inclined frame 12 coupled to a shorter stabilizer frame 14, an "H-shaped" horizontal brace 16 extending between inclined frame 12 and stabilizer frame 14, and a top-step lock 18 as shown, for example, in FIG. 1. Top-step lock 18 includes an extension rod 52 extending upwardly along stabilizer frame 14 to a top step 20 of stepladder 10 and a rod locker 50 used to lock extension rod 52 to stabilizer frame 14 to lock top step 20 in a fixed position relative to the two frames 12, 14 (shown in FIGS. 1 and 3).

Inclined frame 12 includes top step 20, an assist handle 22, a utility platform 24, a left leg 26, a right leg 28, and a plurality of fixed steps 30 coupled therebetween as shown in FIG. 1. Assist handle 22 is coupled to and extends between a top portion of left leg 26 and right leg 28 to assist the user, for example, in maintaining balance while using stepladder 10. Top step 20 and H-shaped horizontal brace 16 provide upper and lower bracing means, respectively, to inhibit undesired collapsing when stepladder 10 is in the expanded use position.

Figure 4:
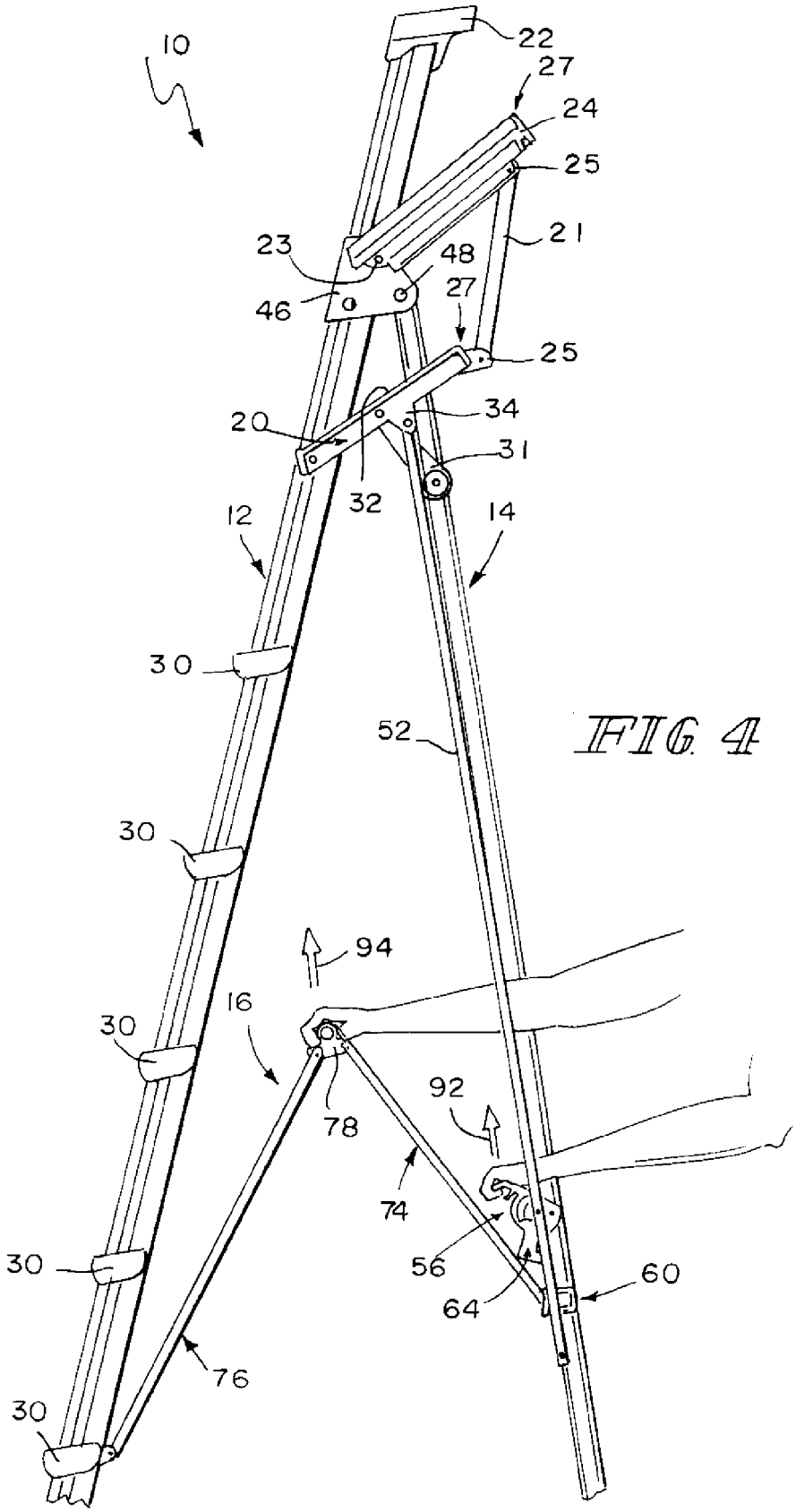
FIG. 4 is a view similar to FIG. 3 showing a partly collapsed stepladder and further showing a user gripping a handgrip provided on an upper portion of a pivotable latch included in the rod locker with one hand and gripping a horizontal brace actuator included in the H-shaped horizontal brace with the other hand during controlled collapse of the stepladder from the expanded use position toward the collapsed storage position.

Utility platform 24 is pivotably coupled below assist handle 22 between left and right legs 26, 28, and is configured to allow the user to rest, for example, tools or other implements while using stepladder 10. Utility platform 24 includes a platform support link 21 pivotably coupled to a pivot support mount 25 formed on a distal end 27 of both utility platform 24 and top step 20 and positioned to extend therebetween, as suggested in FIG. 4. Platform support link 21 urges utility platform 24 to pivot about utility platform pivot axis 23 in response to pivoting movement of top step 20 when, for example, stepladder 10 is moved from the expanded use position toward the collapsed storage position (as shown in FIG. 4).

Figure 7:
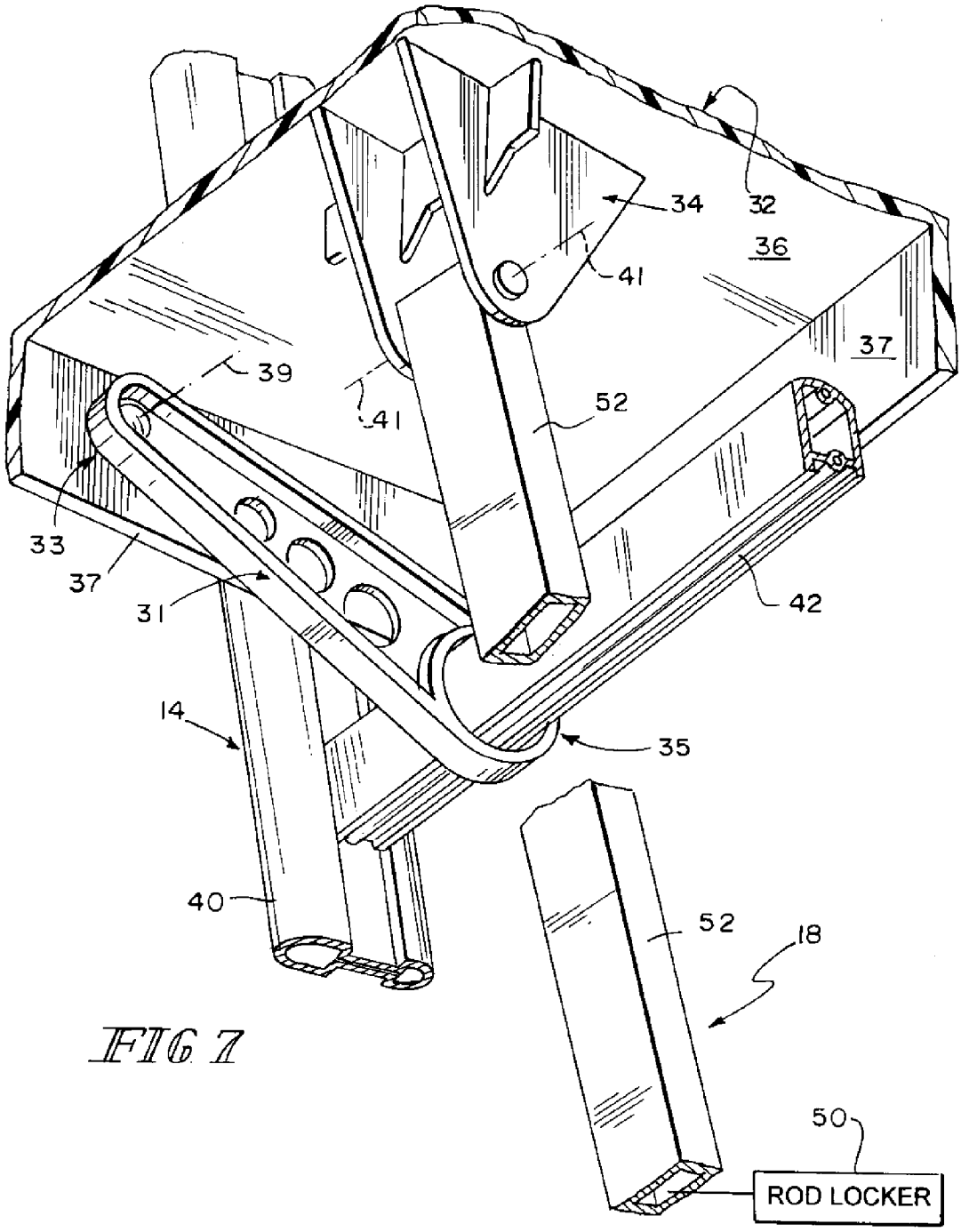
FIG. 7 is a perspective view of the stepladder of FIG. 5, with portions broken away, showing the extension rod extending downwardly from an extension rod mount included in the top step toward the rod locker.
Figure 11:
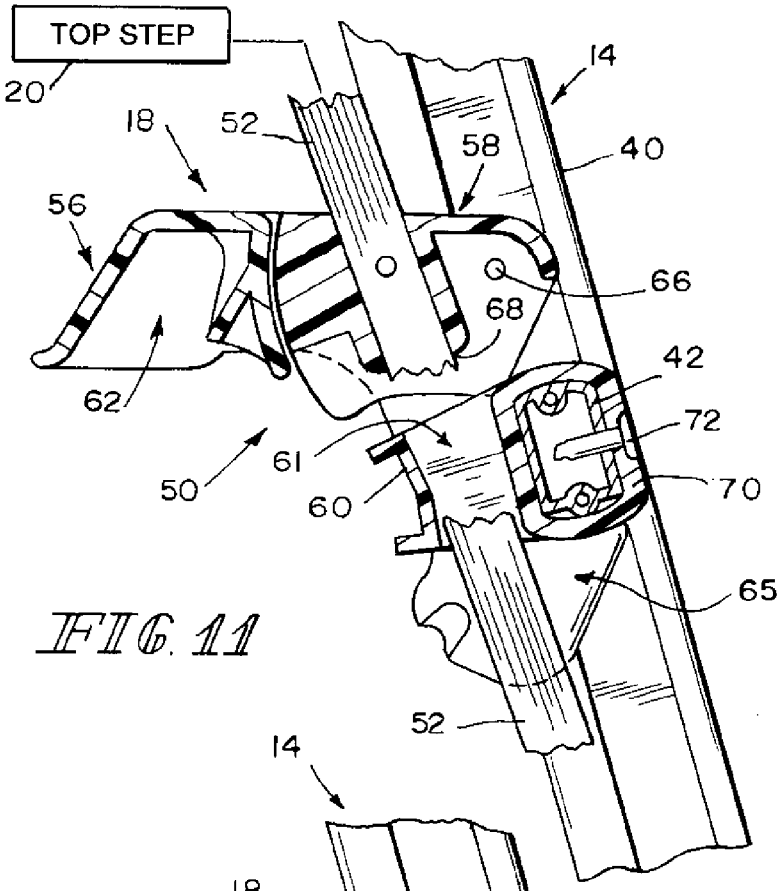
FIG. 11 is a sectional view taken along line 11-11 of FIG. 1, with portions broken away, showing the stepladder in the use position of FIGS. 1 and 3 and showing the rod locker in the locked position wherein the pivotable latch is mounted for pivotable movement about a horizontal pivot axis to a latch mount block included in the rod locker, the latch mount block includes an aperture receiving the extension rod, the rod guider is coupled to the anchor rung and formed to include a channel receiving the extension rod for sliding movement therein, and the pivotable latch includes a latch hook at one end engaging the anchor rung to "lock" the extension rod in a fixed position relative to the stabilizer frame and a handgrip at another end providing a finger-receiving portion for a latch operator.
Figure 12:
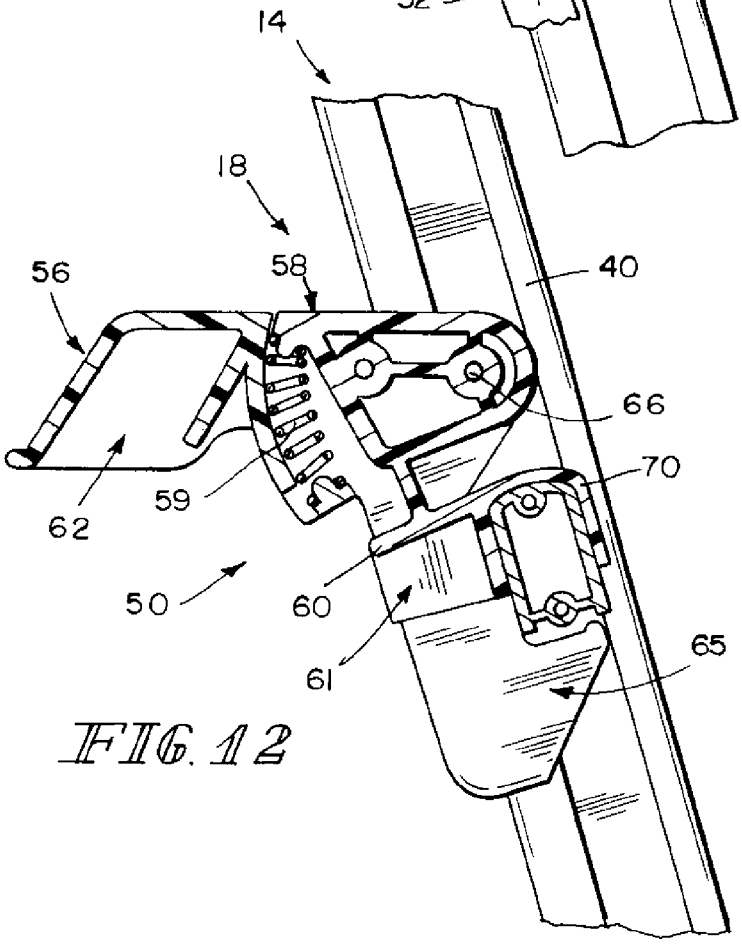
FIG. 12 is a view similar to FIG. 11 showing a spring included in the rod locker and arranged within the latch mount block to urge the latch to pivot about the horizontal pivot axis relative to the latch mount block to cause the first and second latch hooks to mate with the anchor rung when the stepladder is in the expanded use position of FIGS. 1 and 3.

Top step 20 is coupled to inclined frame 12 for pivotable movement relative to inclined frame 12 about a top-step pivot axis 29. Top step 20 includes an upwardly facing step platform 32, an extension rod mount 34 depending from a bottom surface 36 of top step 20 and coupled to extension rod 52 to establish a pivot axis 41, a lip portion 37 depending from and surrounding bottom surface 36, and a top step pivot guide 31, as shown, for example, in FIG. 7. Top step pivot guide 31 is pivotably coupled on a first end 33 to lip portion 37 to establish a pivot axis 39 and pivotably coupled on a second end 35 to a companion rung 42.

Stabilizer frame 14 includes a first vertical member 38, a second vertical member 40, and a plurality of rungs 42 extending therebetween, as shown in FIG. 1. An upper portion 44 of stabilizer frame 14 is pivotably coupled to a frame hinge 46 formed between inclined frame 12 and stabilizer frame 14 to establish a pivot axis 48 therebetween. Frame hinge 46 allows stepladder 10 to be moved between a collapsed storage position as shown in FIG. 8 where inclined frame 12 and stabilizer frame 14 are arranged to lie in a general parallel relation to one another and the expanded use position where inclined frame 12 and stabilizer frame 14 are arranged to lie in a non-parallel relation to one another as shown in FIGS. 1 and 3.

Figure 3:
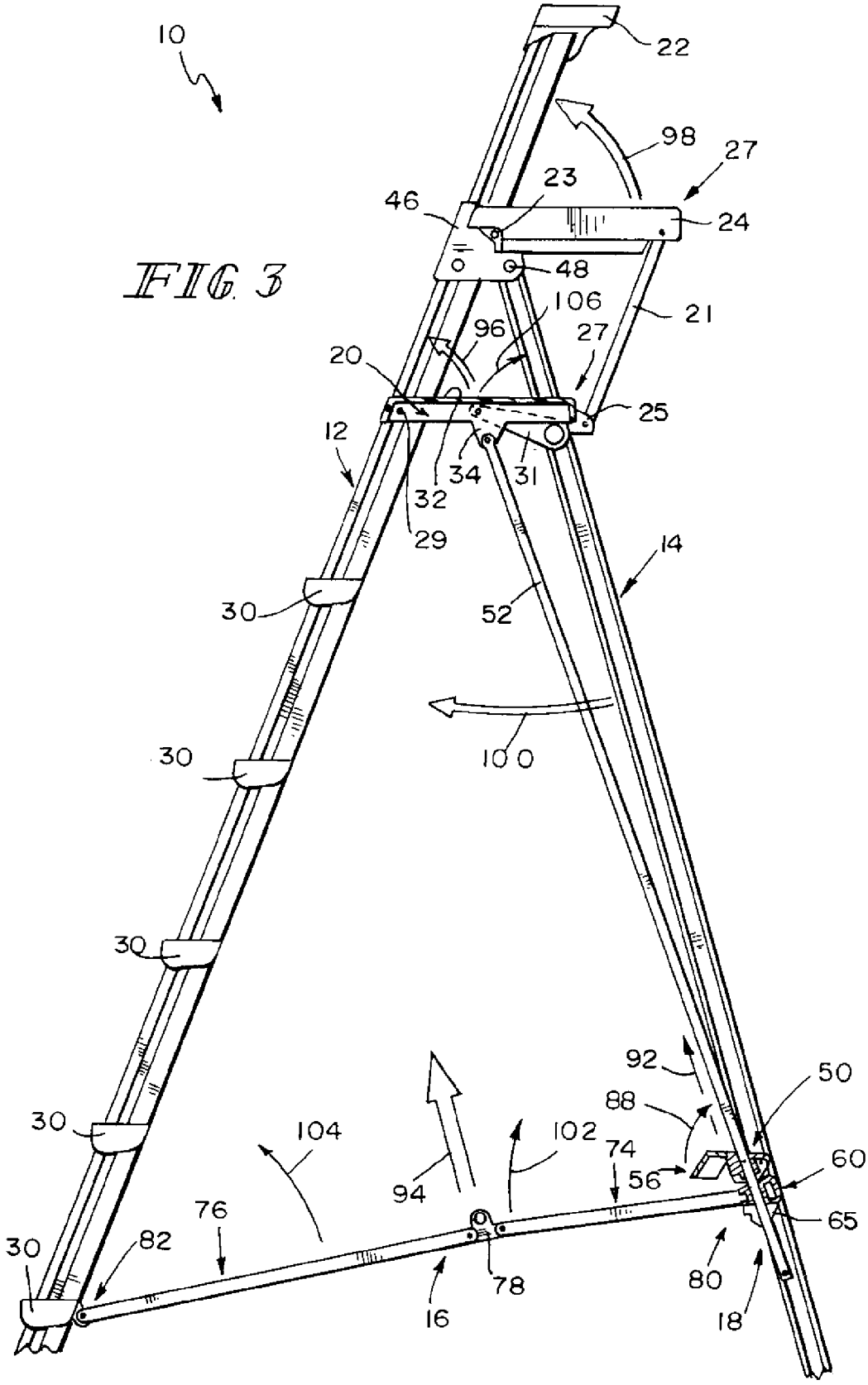
FIG. 3 is a side elevation view of the stepladder of FIG. 1, with portions broken away, showing the stepladder in an expanded use position and further showing the directions of movement of elements of the stepladder when moved from the expanded use position shown in FIG. 1 to a collapsed storage position shown in FIG. 8.

H-shaped horizontal brace 18 includes a shorter segment 74, a longer segment 76, and a brace actuator 78, as shown, for example, in FIG. 3. Shorter segment 74 includes first end portion 80 coupled to a horizontal anchor rung 54. Longer segment 76 includes second end portion 82 coupled to a companion one of the fixed steps 30. Brace actuator 78 is pivotably coupled to and connects shorter and longer segments 74, 76. As stepladder 10 is moved from the expanded use position toward the collapsed storage position (as shown in FIG. 4) brace actuator 78 is moved toward top step 20 in a direction 94 in response to manual operation of brace actuator 78 by the user to cause shorter segment 74 and longer segment 76 to move toward one another in directions 102 and 104, respectively, to lie in a generally side-by-side parallel relationship to one another.

Figure 5:
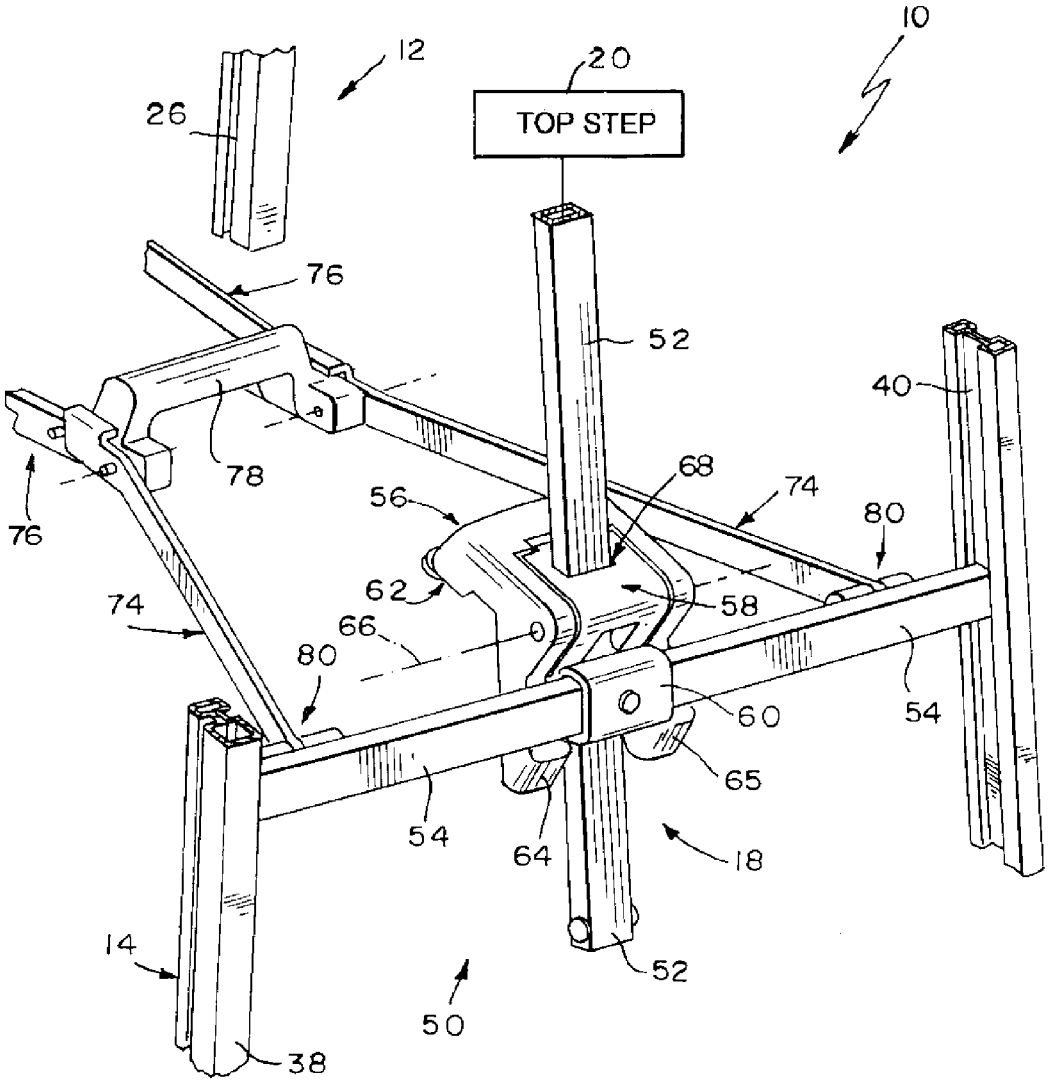
FIG. 5 is an enlarged perspective view of the stepladder of FIG. 1, with portions broken away, showing the extension rod extending through an aperture formed in the rod locker and engagement of first and second latch hooks provided on a lower portion of the pivotable latch with a horizontal anchor rung included in the stabilizer frame.
Figure 6:
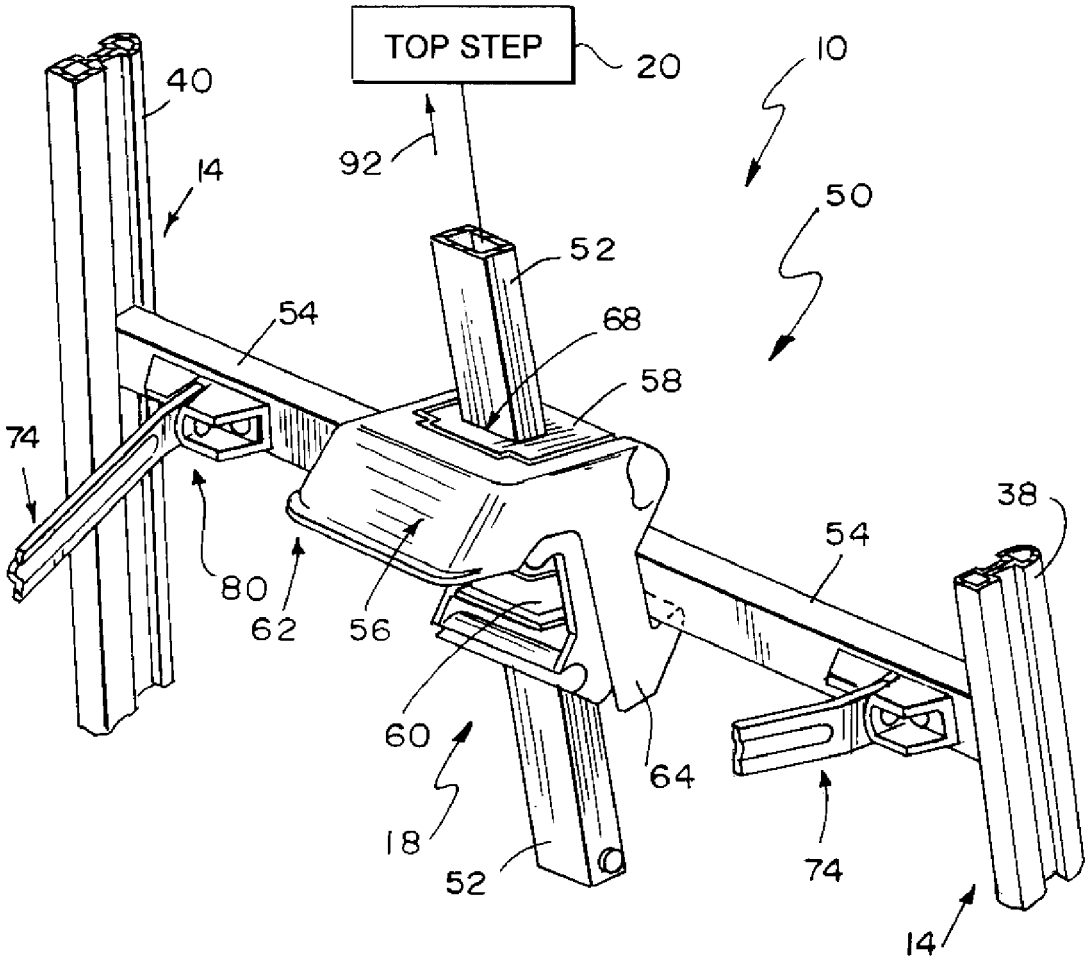
FIG. 6 is another perspective view of the rod locker of FIG. 5 taken from a different point of view showing the pivotable latch and its hand grip and one of its latch hooks.

Top-step lock 18 includes rod locker 50, extension rod 52, and horizontal anchor rung 54, as shown best in FIGS. 5 and 6. Rod locker 50 includes a pivotable latch 56, a latch mount block 58, and a rod guider 60. Pivotable latch 56 is formed to include a grip portion 62 on one end extending between a first latch hook 64 and a second latch hook 65, formed on another end, to engage a portion of horizontal anchor rung 54 to "lock" extension rod 52 in a fixed position relative to stabilizer frame 14. Pivotable latch 56 is mounted for pivotable movement about a horizontal pivot axis 66 and positioned to lie between extension rod 52 and stabilizer frame 14. Rod locker 50 further includes a spring 59 arranged within latch mount block 58 to urge pivotable latch 56 to pivot about pivot axis 66 relative to latch mount block 58 to cause first and second latch hooks 64, 65 to mate with horizontal anchor rung 54 when stepladder 10 is in the expanded use position of FIGS. 1 and 3.

Latch mount block 58 is formed to include an aperture 68 to receive a portion of extension rod 52 therethrough. Latch mount block 58 is fixedly coupled to extension rod 52. Extension rod 52 extends upwardly from rod locker 50 along stabilizer frame 14 and is coupled to extension rod mount 34 formed on bottom surface 36 of top step 20. Horizontal anchor rung 54 extends between first and second vertical members 38, 40 of stabilizer frame 14. Rod guider 60 includes a rung mount portion 70 coupled to horizontal anchor rung 54 with a fastener 72 and is formed to include a channel 61 to receive a portion of extension rod 52 for sliding movement therein.

Rod locker 50 is movable in the manner suggested in FIGS. 3 and 4 between a locked position (associated with the expanded use position) where first and second latch hooks 64, 65 are coupled to horizontal anchor rung 54 (also shown in FIGS. 5, 6, and 10) to inhibit vertical movement of extension rod 52 in relation to stabilizer frame 14 and thus maintain top step 20 and upwardly facing step platform 32 in a generally horizontal orientation, and an unlocked position (associated with the collapsed storage position) where first and second latch hooks 64, 65 are disengaged from horizontal anchor rung 54 to move pivotable latch 56 and extension rod 52 upwardly toward top step 20 in relation to stabilizer frame 14 to cause top step 20 to pivot about pivot axis 29.

Referring now to FIG. 9, rod locker 50 is also movable to the locked position from the unlocked position. Pivotable latch 56 is moved in a direction 87 to cause camming movement 89 of first and second latch hooks 64, 65 on horizontal anchor rung 54 during movement from the unlocked position above horizontal anchor rung 54 toward a pivoted position alongside horizontal anchor rung 54, then toward an engaged position below horizontal anchor rung 54.

As mentioned above, stepladder 10 is movable between the expanded use position, shown in FIG. 1, and the collapsed storage position shown, with portions broken away, in FIG. 8. In the expanded use position, inclined frame 12 (including left and right legs 26, 28) is spaced apart from stabilizer frame 14 (including first and second vertical members 38, 40). In the collapsed storage position, right leg 28 and first vertical member 38 are adjacent to each other (not shown) and left leg 26 and second vertical member 40 are adjacent to each other, as shown in FIG. 8.

Figure 13:
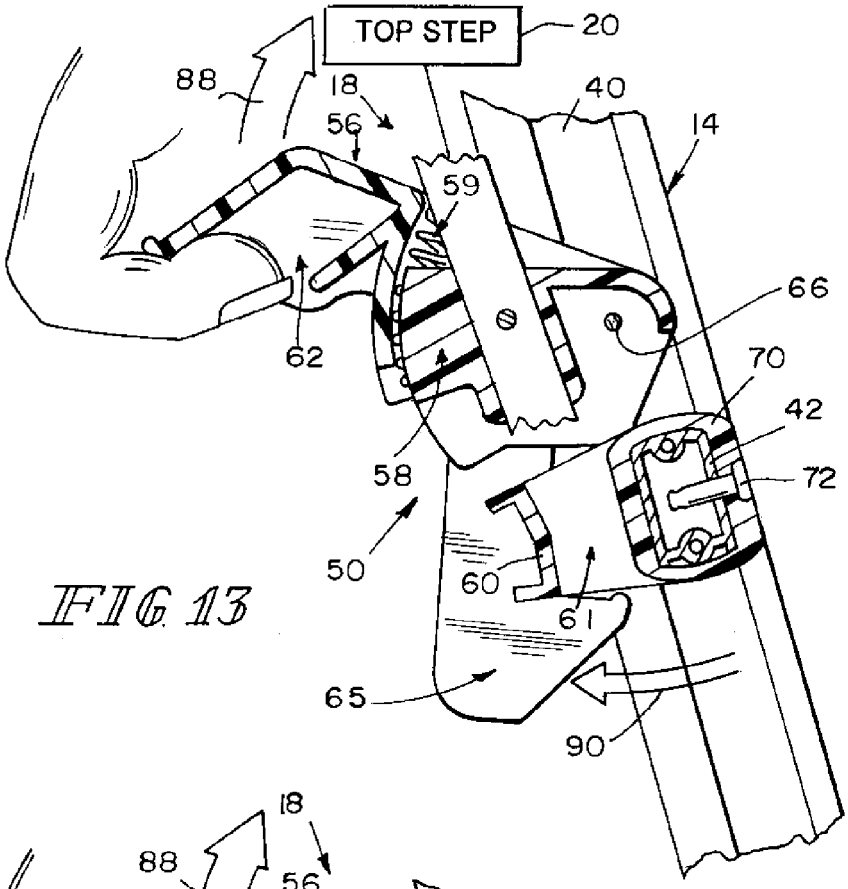
FIG. 13 is a view similar to FIGS. 11 and 12, showing one of the latch hooks being moved in response to the manual operation of the latch by a user to cause the latch hook to uncouple from the anchor rung to allow the extension rod to move upwardly in relation to the stabilizer frame so that the user can "collapse" the stepladder to assume the collapsed storage position.
Figure 14:
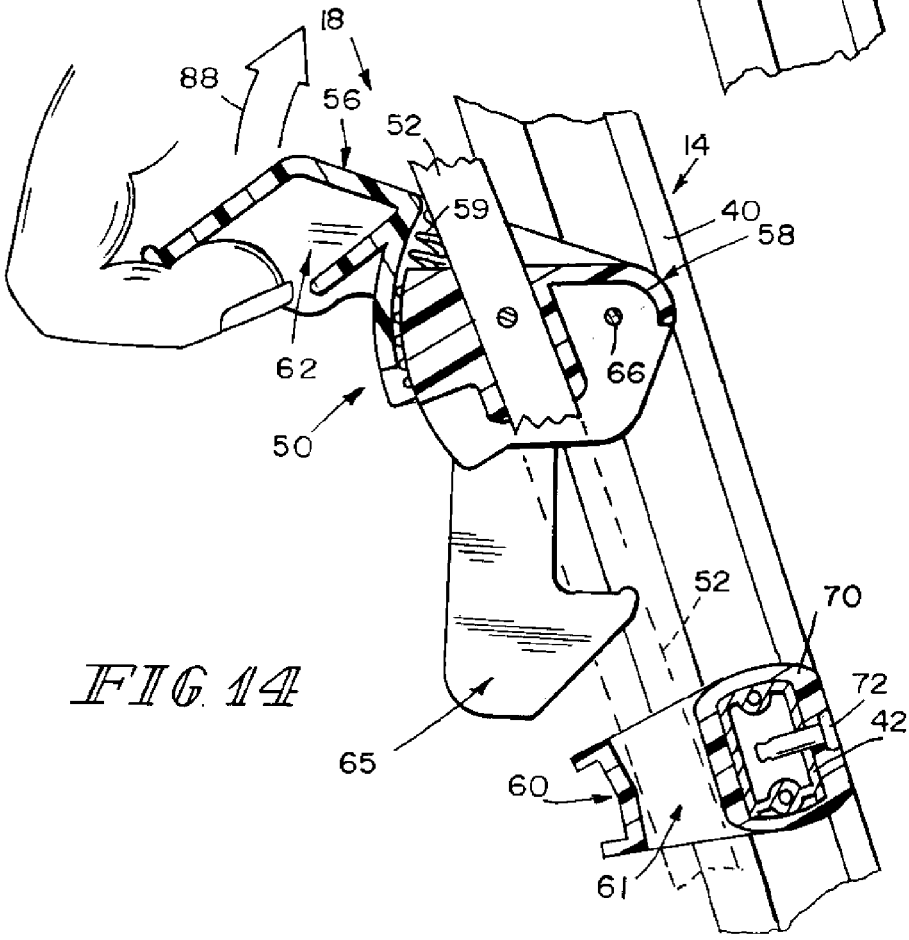
FIG. 14 is a view similar to FIGS. 11-13, showing further movement of the rod locker to an unlocked position.

In operation, to move stepladder 10 from the expanded use position toward the collapsed storage position, the user first moves pivotable latch 56 from the locked position to the unlocked position by grasping grip portion 62 and pivoting grip portion 62 away from inclined frame 12 and toward stabilizer frame 14 in a direction 88 to disengage first and second latch hooks 64, 65 from horizontal anchor rung 54 (as shown in FIG. 13). When first and second latch hooks 64, 65 have disengaged from horizontal anchor rung 54 in a direction 90, the user is able to move pivotable latch 56 and brace actuator 78 toward top step 20 in directions 92 and 94, respectively (as shown by arrows 84 in FIG. 4).

As latch 56 and brace actuator 78 are moved toward top step 20, extension rod 52 urges top step 20 to pivot about top-step pivot axis 29 in a direction 96 and top step pivot guide to move in a direction 106 so that top step 20 is moved toward a position substantially parallel to inclined frame 12 and positioned to lie between left and right legs 26, 28. Similarly, as top step 20 pivots about top-step pivot axis 29 in direction 96, utility platform 24 is urged by platform support link 21 to pivot about utility platform pivot axis 23 in a direction 98 to likewise move toward a position substantially parallel to inclined frame 12 and positioned to lie between left and right legs 26, 28. Simultaneously, stabilizer frame 14 is moved in a direction 100 to lie substantially parallel to inclined frame 12, while shorter segment 74 is moved in a direction 102 and longer segment 76 is moved in a direction 104 so that first end portion 80 and second end portion 82 are moved toward one another.

The invention claimed is:

1. A stepladder comprising an inclined frame including a left leg, a right leg, a utility platform extending between the left and right legs, and a top step configured to hold the weight of a human and extending between the left and right legs below the utility platform, a stabilizer frame including first and second vertical members coupled to the inclined frame for pivotable movement about a frame pivot axis, and a top-step lock including an extension rod extending upwardly along the stabilizer frame to the top step, a rod locker configured to lock the extension rod to the stabilizer frame to lock the top step in a fixed position relative to the inclined frame and the stabilizer frame, and a horizontal anchor rung extending between and directly connected to the first and second vertical members, and wherein the rod locker includes a pivotable latch that can directly connect and disconnect from the horizontal anchor rung and is formed to include a grip and first and second latch hooks, the grip arranged to extend between the first latch hook and the second latch hook, and a latch mount block coupled to the extension rod and configured to mount the pivotable latch.

2. The stepladder of claim 1, wherein the pivotable latch is mounted to the latch mount block for pivotable movement about a horizontal pivot axis and positioned to lie between the extension rod and the stabilizer frame.

3. The stepladder of claim 1, wherein the rod locker further includes a spring arranged within the latch mount block to urge the pivotable latch to pivot about a pivot axis relative to the latch mount block to cause the first and second latch hooks to mate with the horizontal anchor rung.

4. The stepladder of claim 1, wherein the rod locker is arranged to engage the horizontal anchor rung to lock the extension rod in a fixed position relative to the horizontal anchor rung.

5. A stepladder comprising a frame including an inclined frame member having a left leg, a right leg, a utility platform arranged to extend between the left and right legs, and a top step configured to hold the weight of a human and arranged to extend between the left and right legs below the utility platform, an actuator positioned to lie below the top step, and means for coupling the actuator to the top step so that, when the actuator is moved to a first position, the top step is locked in an expanded use position blocking pivotable movement relative to the frame, and so that, when the actuator is moved to a second position, the top step is unlocked to allow pivotable movement of the top step relative to the frame, wherein the coupling means includes an extension rod having one end coupled to the top step and a second end coupled to a rod locker, further comprising a stabilizer frame member coupled to the inclined frame member for pivotable movement about a frame pivot axis, the stabilizer frame includes first and second vertical members, a horizontal anchor rung arranged to extend between the first and second vertical members, and a rod guider coupled to the horizontal anchor rung to receive at least a portion of the extension rod, and wherein the rod locker includes a pivotable latch that can directly connect and disconnect from the horizontal anchor rung and is formed to include a grip and first and second latch hooks, the grip arranged to extend between the first latch hook and the second latch hook, and a latch mount block coupled to the extension rod and configured to mount the pivotable latch.

6. The stepladder of claim 5, wherein the top step includes an extension rod mount arranged to depend from a bottom surface of the top step and coupled to the extension rod to establish a pivot axis thereabout.

7. The stepladder of claim 5, wherein the extension rod is positioned to extend upwardly from the horizontal anchor rung along the stabilizer frame member.

8. The stepladder of claim 5, wherein the top step includes an upwardly facing step platform, a lip arranged to depend from and to surround the upwardly facing step platform, and a top step pivot guide configured to extend between the lip and the stabilizer frame.

9. The stepladder of claim 5, wherein the utility platform further includes a platform support link coupled to the top step and positioned to extend therebetween to urge the utility platform to pivot about a utility platform pivot axis in response to pivoting movement of the top step.

10. A stepladder comprising a frame including an inclined frame member having a left leg, a right leg, a utility platform arranged to extend between the left and right legs, and a top step configured to hold the weight of a human and arranged to extend between the left and right legs below the utility platform, and a stabilizer frame member coupled to the inclined frame member for pivotable movement about a frame pivot axis, the stabilizer frame member having first and second vertical members and a horizontal anchor rung arranged to extend between the first and second vertical members, an actuator positioned to lie below the top step, and an extension rod arranged to extend upwardly along the stabilizer frame member, the extension rod is coupled on one end to the top step and is coupled on an opposite end to a rod locker, wherein the rod locker includes a rod guider directly coupled to the horizontal anchor rung and configured to receive at least a portion of the extension rod, and wherein the rod locker includes a pivotable latch that can directly connect and disconnect from the horizontal anchor rung and is formed to include a grip and first and second latch hooks, the grip arranged to extend between the first latch hook and the second latch hook, and a latch mount block coupled to the extension rod and configured to mount the pivotable latch.

11. The stepladder of claim 10, wherein the top step includes an extension rod mount arranged to depend from a bottom surface of the top step and coupled to the extension rod to establish a pivot axis thereabout.

12. The stepladder of claim 10, wherein the pivotable latch, the latch mount block, and the rod guider cooperate to provide the rod locker, the rod locker being arranged to engage the horizontal anchor rung to lock the extension rod in a fixed position relative to the horizontal anchor rung.

13. The stepladder of claim 10, wherein the pivotable latch is arranged to engage the horizontal anchor rung to lock the extension rod in a fixed position relative to the horizontal anchor rung.

14. The stepladder of claim 10, wherein the utility platform includes a platform support link pivotably coupled to the top step and positioned to extend therebetween to urge the utility platform to pivot about a utility platform pivot axis in response to pivoting movement of the top step.

* * * * *